US012687157B2

(12) United States Patent
Biliakov

(10) Patent No.: US 12,687,157 B2
(45) Date of Patent: Jul. 21, 2026

(54) COULISSE—ECCENTRIC MOTOR

(71) Applicant: Volodymyr Biliakov, Dnipro (UA)

(72) Inventor: Volodymyr Biliakov, Dnipro (UA)

( * ) Notice: Subject to any disclaimer, the term of this patent is extended or adjusted under 35 U.S.C. 154(b) by 0 days.

(21) Appl. No.: 19/055,848

(22) Filed: Feb. 18, 2025

(65) Prior Publication Data

US 2026/0092598 A1 Apr. 2, 2026

(30) Foreign Application Priority Data

Sep. 30, 2024 (GB) ..... 202404700

(51) Int. Cl.

| | |
|---|---|
| ***F04B 27/08*** | (2006.01) |
| ***F01C 1/344*** | (2006.01) |
| ***F01C 21/00*** | (2006.01) |
| ***F01C 21/08*** | (2006.01) |

(52) U.S. Cl.

CPC ..... *F04B 27/0804* (2013.01); *F01C 1/344* (2013.01); *F01C 21/0809* (2013.01); *F01C 2021/12* (2013.01)

(58) Field of Classification Search

CPC ..... F04B 27/0804; F04B 23/10; F04B 3/003; F04B 1/1136

See application file for complete search history.

(56) References Cited

U.S. PATENT DOCUMENTS 2,459,388 A * 1/1949 Munroe ..... F04B 3/003 417/466

2,504,945 A * 4/1950 Austin ..... F04B 3/003 417/466

* cited by examiner

*Primary Examiner* — Mary A Davis

(74) *Attorney, Agent, or Firm* — Nadya Reingand

(57) ABSTRACT

The rod-free mechanisms are used for converting rotational motion into reciprocating motion and vice versa. The mechanism can be used in displacement pumps and compressors, as well as in internal and external combustion engines, cubic expansion engines, steam engines, hydro and pneumatic engines. Coulisse-eccentric motor automatically feeds and distributes the actuation fluid to the swept-volume capacities. Coulisse-eccentric motor is easy to manufacture, contains a minimum of parts, such as a housing, a coulisse and an eccentric, can be made entirely of ceramics, and allows converting the pressure difference between the two internal volumes of the coulisse into rotational motion on the shaft, and vice versa. Coulisse-eccentric motor in motion allows reversing, changing the shaft torque and compression ratio, while all engine components operate normally and are not subjected to excessive loads.

10 Claims, 9 Drawing Sheets

COULISSE—ECCENTRIC MOTOR

FIELD OF THE INVENTION

The coulisse-eccentric motor, belongs to the field of mechanical engineering, specifically to mechanisms that convert rotational motion into reciprocating motion and vice versa.

TECHNICAL FIELD

The coulisse-eccentric motor can be used in volumetric pumps and compressors, as well as in internal and external combustion engines, expansion engines, steam engines, hydraulic and pneumatic engines.

BACKGROUND OF THE INVENTION

All existing engines, pumps, and compressors that convert the mechanical difference in pressure into reciprocating motion, rotational motion, or vice versa can be divided into two classes: piston engines and rotary engines. Piston engines can be conditionally divided into six types:

- In the first type, the conversion occurs through a crankshaft mechanism;
- In the second type, it occurs through gear racks, ratchet wheels, and gears;
- In the third type, it occurs through planetary gears and rotors;
- In the fourth type, it occurs through runner on cyclic surface;
- In the fifth type, axial pressure is applied to an inclined surface;
- In the sixth type, it is achieved by the movement of a crank or eccentric in a plane, driven by pistons that perform reciprocating motion and are classified as crankless engines.

There is also a separate class of engines—rotary engines—that convert the difference in pressure in two or more volumes into rotational motion on a shaft and vice versa, converting rotational motion on a shaft into a difference in pressure in two or more volumes.

The coulisse-eccentric motor occupies an intermediate position between rodless piston engines and rotary engines.

Similar solutions to the coulisse-eccentric motor are known as crankless engines are described in the book "Balandin S. S. 'Crankless Internal Combustion Engines' M.: Mashinostroyenie 1968". The main drawback of these engines, why they have not found widespread application, is the high precision requirements for manufacturing parts and the individual adapting of components, which hinders mass production. These engines differ from the proposed coulisse-eccentric motor in that they contain a plurality of complex parts, and with minor wear of the components, the engine can seize, which is particularly dangerous for vehicles. Additionally, this type of engine has a crankshaft and several rods that have extra friction points, performing complex circular and reciprocating motion with a change in the direction of movement, thereby experiencing alternating loads that ultimately negatively affect the service life, efficiency, and cause vibrations. Furthermore, these engines, in addition to the mechanism for converting reciprocating motion into rotational motion, have an additional mechanism for distributing and supplying the working fluid to the working volumes. These engines do not provide for reverse operation at all.

The Waissi engine, U.S. Pat. No. 8,109,244 B1 and No. 5402755, differs from what is claimed in that the eccentric moves along guides that are positioned at a right angle to the piston displacement vector. The second distinction and drawback is the ambiguous direction of the engine shaft rotation during startup or reverse. The third distinction and drawback is that reversing the engine can only be done after the engine has stopped. The fourth distinction and drawback is that the eccentric and the guides it moves along experience alternating impact loads during the reciprocating motion of the pistons, leading to wear and vibrations. The fifth distinction is that the engine does not provide for the introduction of working fluid between the eccentric and the pistons. The sixth distinction is that additional mechanisms are required to manage the supply and discharge of the working fluid.

The closest solution to the coulisse-eccentric motor is patent RU2035603C1 from 1995, which has the following differences:

- At the top and bottom dead centers of the pistons, the crank pin experiences impact loads and changes in the force vector. Therefore, the crank and the rocker are subject to significant wear and vibrations;
- There is no supply of working fluid between the crank, which is analogous to the eccentric, and the rocker with the pistons;
- There is no automatic distribution of the supply and discharge of the working fluid to the working volumes solely due to the mechanism that converts reciprocating motion into rotational motion;
- There is no possibility to reverse the rotation of the crankshaft while in operation without stopping the engine;
- The direction of rotation of the shaft at engine start or during its reverse is unknown without the use of additional mechanisms.

SUMMARY OF THE INVENTION

The main distinction of the coulisse-eccentric motor is that the working fluid is supplied to the volume between the eccentric and the coulisse, which causes them to repel each other. Due to the inclination of the working surfaces of the coulisse relative to the guide housing and the movement of the coulisse relative to the eccentric shaft, the eccentric rotates, while the coulisse moves along the guides of the housing, thereby ensuring the synchronization of the coulisse's movement and the eccentric's rotation. The synchronization of the eccentric's rotation and the coulisse's movement ensures the synchronized supply and discharge of the working fluid to the internal volumes of the coulisse through openings on the working surface of the eccentric.

The main task that the coulisse-eccentric motor addresses is to possess the positive characteristics of both rotary and piston engines while avoiding their main drawbacks. The coulisse-eccentric motor, is a new class of engines that combines rotary engines and piston engines.

It occupies an intermediate position between rotary engines, where the working fluid is supplied between the rotor and the casing, and piston engines, where the working fluid is supplied between the casing and the piston. Due to its design, the coulisse-eccentric motor is free from many disadvantages of both rotary and piston engines while simultaneously retaining their advantages. Like a rotary engine, the coulisse-eccentric motor has a small number of easily manufactured parts, automatic distribution of supply and discharge of the working fluid to the working volumes, and the ability to reverse while in operation. By using coulisse in the coulisse-eccentric motor, it is free from the drawback of rotary engines, which is the backflow of the working fluid from the inlet to the outlet, especially at dead points. From piston engines, the coulisse-eccentric motor has inherited the presence of pistons with their reciprocating motion and an eccentric mechanism, which is analogous to a crankshaft. Unlike piston engines, the coulisse-eccentric motor does not have a complex system for supplying and discharging the working fluid; there are no significant impact loads, and it is possible to reverse the rotation of the shaft while in operation, which is practically impossible for piston engines. Additionally, it is worth noting that the coulisse-eccentric motor can utilize several types of working fluids without complicating the design, has low vibrations, and can be made entirely of ceramics. The coulisse-eccentric motor also has the unique ability to compensate for wear on the rubbing surfaces by moving the eccentric along its axis.

OBJECT OF THE INVENTION

The coulisse-eccentric motor has a housing, an coulisse, and an eccentric with a shaft on the side surfaces of the eccentric. The housing consists of two side walls connected by inserts. The shaft of the eccentric rotates within the side walls of the housing. The coulisse moves back and forth between the side walls of the housing. Each insert that connects the side walls of the housing has a surface that serves as a guide for the coulisse. The guide of the housing defines the straight line of the vector of the coulisse's movement within the housing. The coulisse has surfaces that slide along the guides of the housing.

The coulisse has an internal chamber where an eccentric is located, dividing it into two internal volumes. The internal volumes change when the eccentric rotates and the coulisse moves. Internal chamber the coulisse has two opposite working surfaces along which the working surface of the eccentric slip. The opposite working surfaces are positioned across from each other at a distance sufficient for the eccentric to rotate between them with the required clearance. The opposite working surfaces have a starting and an ending point that the working surface of the eccentric touches during its rotation. A line that passes through the starting and ending points on the opposite working surfaces has an angle of inclination of less than 90 degrees and more than 0 degrees in relation to the guide's housing.

The essence of the invention lies in the fact that to move the coulisse within the housing, a working fluid is supplied under pressure to one internal volume of the coulisse, while the working fluid is discharged from the other internal volume of the coulisse. The pressure difference between the two internal volumes of the coulisse causes the coulisse to move relative to the eccentric. The movement of the coulisse relative to the eccentric causes the eccentric to rotate due to the tilt of the working surface of the coulisse relative to the guiding housing. To supply and discharge the working fluid into the internal volumes of the coulisse, there are channels with their own openings in the body of the eccentric.

The openings through which the working fluid is supplied to the internal volumes of the coulisse are located on the working surface of the eccentric. When the eccentric rotates and the coulisse moves simultaneously, the openings on the working surface of the eccentric change their position relative to the working surfaces of the coulisse. The openings on the working surface of the eccentric alternately find themselves in one or the other internal volume of the coulisse in sync with the change in the direction of the coulisse's movement. The rotation of the eccentric and the change in the position of its channels with their openings ensure the alternating supply and discharge of the working fluid to the two internal volumes of the coulisse solely through the mechanism that converts the reciprocating motion of the coulisse into the rotational motion of the eccentric. The channels through which the working fluid is supplied to the internal volumes of the coulisse can pass through the body of the eccentric and its shaft, as well as through the body of the eccentric and the side wall of the housing.

To increase the working volume in an coulisse-eccentric motor, two external volumes of the coulisse are used, which are formed between two side walls of the housing with the help of additional housing inserts. The additional housing inserts connect the guides of the housing from both sides relative to the coulisse. The additional housing inserts do not restrict the movement of the coulisse. Each additional housing insert, together with the two housing guides, the wall of the coulisse, and the two side walls of the housing, form and limit the external volumes of the coulisse. The external volumes of the coulisse change as the coulisse moves. The coulisse also has channels with openings in its body that connect one internal volume of the coulisse to an external volume of the coulisse located on the opposite side relative to the eccentric. The working fluid is supplied and discharged from the internal volumes of the coulisse to the external volumes of the coulisse through the channels with their openings in the body of the coulisse. To supply and discharge the working fluid into the internal volumes of the coulisse, the coulisse-eccentric motor may have several channels with openings that pass through the body of the eccentric and its shaft. To supply and discharge the working fluid into the internal volumes of the coulisse, the coulisse-eccentric motor may have several channels with openings that pass through the body of the eccentric and through the side wall of the housing. The coulisse-eccentric motor may have an coulisse that contains two or more internal chambers with their own eccentrics and shafts. All internal chambers of the coulisse typically have a consistent inclination of the opposing working surfaces of the coulisse in relation to the guiding housing and may differ in size and volume.

The coulisse-eccentric motor can have at least one piston—the coulisse stone. The coulisse stone—piston is located inside the inner chamber of the coulisse between two side walls of the housing. The coulisse stone—piston can be made as a single part that has two surfaces sliding against the opposite working surfaces of the coulisse and has a surface that slides against the working surface of the eccentric during its rotation. Additionally, the coulisse stone—piston can consist of two separate parts, each having a surface that slides against the working surface of the eccentric and a surface that slides against one of the opposite working surfaces of the coulisse. There are also surfaces of the coulisse stone—piston that separate and limit the two internal volumes of the coulisse. The opposite working surfaces of the coulisse serve as guides for the coulisse stone—piston. The piston—coulisse stone separates the working surface of the eccentric from the opposite working surfaces of the coulisse. The size of the surface of the piston—coulisse stone, over which the working surface of the eccentric slides, is larger than the opening on the working surface of the eccentric through which the working fluid is supplied or discharged into the internal volumes of the coulisse. The size of the surface of the piston—coulisse stone, over which the working surface of the eccentric slides, determines the timing and duration of the supply or discharge of the working fluid into the internal volumes of the coulisse by covering the openings on the working surface of the eccentric at the appropriate time.

To compensate for the wear of the guideways of the housing, the working surfaces of the coulisse, and the working surfaces of the eccentric, their surfaces are inclined relative to the axis of rotation of the eccentric shaft. The working surface of the eccentric has the shape of a truncated cone. To compensate for the wear of the guideways of the housing and the working surfaces of the coulisse and the eccentric, it is sufficient to shift the eccentric along its axis. The gap formed between the side walls of the housing and the coulisse, as well as between the side walls of the housing and the eccentric, should be closed with gaskets, or the distance between the two side walls of the housing should be reduced.

The use of an coulisse-eccentric motor provides the following technical results:

- The coulisse-eccentric motor provides automatic feeding and discharge of the working fluid to the internal volumes of the coulisse solely through a mechanism that converts rotational motion into reciprocating motion;
- The coulisse-eccentric motor has a small number of parts, and they are simple to manufacture;
- The coulisse-eccentric motor can perform the functions of an engine, pump, or compressor;
- The coulisse-eccentric motor ensures a definite direction of shaft rotation with the same feeding of the working fluid into the same channel in the body of the eccentric;
- Wear of parts in an coulisse-eccentric motor does not cause operational malfunctions but leads to a decrease in efficiency;
- The coulisse-eccentric motor allows for reversing the rotation of the shaft during operation without stopping, while all components operate in normal mode and do not experience increased loads;
- The coulisse-eccentric motor supports the use of multiple types of working fluid;
- The coulisse-eccentric motor allows for changing the timing and duration of the feeding of the working fluid to the internal volumes of the coulisse by altering the sizes and positions of the openings in the feed and discharge channels;
- The coulisse-eccentric motor can be made entirely of ceramics, glass, pyrolytic carbon, etc., which are biocompatible and neutral to electromagnetic influence;
- The coulisse-eccentric motor allows for compensation of wear on the friction surfaces by changing the position of the eccentric along the axis of the eccentric shaft.

Additional Tasks

Additional tasks that the use of the coulisse-eccentric motor solves:

- It has a large working volume, which includes two internal volumes of the coulisse and two external volumes of the coulisse compared to the total volume of the coulisse-eccentric motor;
- By using different openings with their own channels in the body of the eccentric for the supply or discharge of the working fluid, or by changing their sizes, it is possible to adjust the timing and duration of the supply of the working fluid to the internal volumes of the slider;
- By using additional openings with their own channels in the side walls of the housing or on the shaft of the eccentric, it is possible to achieve separate supply of several types of working medium to the internal volumes of the coulisse;
- When using several internal chambers of the coulisse with their own eccentrics, shafts, and channels with openings in one coulisse, it allows for the reuse of the working fluid;
- When the housing of the coulisse-eccentric motor is heated, it can simultaneously perform the functions of a steam boiler—steam generator and engine;
- The use of a piston—coulisse stone reduces the transfer of the working fluid between the two internal volumes of the coulisse;
- By changing the dimensions of the piston—coulisse stone, it is possible to alter the duration and timing of the working fluid being supplied to or discharged from the internal volumes of the coulisse;
- If the guiding surfaces of the housing and also the guiding surfaces the coulisse which slide along them and opposite working surfaces internal of the coulisse with a working surface of the eccentric to execute inclined relative to the axis of rotation of the eccentric shaft, then the wear of these surfaces can be compensated by moving the eccentric shaft along its axis.

OBJECT AND SUMMARY OF THE INVENTION

Due to the fact that in a coulisse-eccentric motor the working fluid is supplied and discharged to the internal volumes of the coulisse through openings with their own channels in the body of the rotating eccentric, and at the same time the position of the coulisse changes, synchronization of the coulisse movement with the rotation of the eccentric is ensured. This, in turn, guarantees a synchronous automatic change in the supply and discharge of the working fluid to the internal volumes of the coulisse. Because in a coulisse-eccentric motor, when using the external volumes of the coulisse, they are connected by channels with their own openings to the opposite internal volumes of the coulisse relative to the eccentric, the automatic change in the supply and discharge of the working fluid in the internal volumes of the coulisse ensures an automatic change in the supply and discharge of the working fluid in the external volumes of the coulisse.

Thanks to the simple design of the coulisse-eccentric motor, it has a small number of parts, and they are easy to manufacture. In the simplest version, if the side walls are combined with inserts and friction bearings are used, the entire motor will consist of three parts: a two-part casing, a coulisse, and an eccentric with its shaft. Due to the fact that the working cycle of the coulisse-eccentric motor involves reversing the movement of the slider in each cycle, and this is a standard working cycle, the motor's reverse operation is no different from the usual cycle and is performed without excessive or impact loads.

Thanks to the fact that in a coulisse-eccentric motor, the rotation of the eccentric and the change in the position of the supply and discharge channels for the working fluid to the internal volumes of the cam are synchronized with the movement of the cam within the housing. When using the same channels for the supply and discharge of the working fluid, with their respective openings, the eccentric will always rotate in the same direction regardless of the stopping position of the coulisse. Since the coulisse-eccentric motor has only two non-stationary parts, one of which performs rotational movements while the other performs reciprocating movements, impact loads can only occur when the direction of the coulisse's movement changes. Due to the synchronization of the supply of the working fluid to the internal volumes of the coulisse with the movement of the coulisse, when the direction of the coulisse's movement changes, the supply of the working fluid to the internal volumes of the coulisse also changes, which dampens the movement of the coulisse and smoothly reverses it, thereby eliminating any significant impact loads.

In a coulisse-eccentric motor, wear on the sliding surfaces leads to an increase in the gap between them, which in turn causes the working fluid to flow either between the two internal volumes of the coulisse or between the two external volumes of the coulisse. This flow of the working fluid reduces the relative pressure and speed of the cam's movement and increases the consumption of the working fluid. At the same time, there are no components of the coulisse-eccentric motor or forces that could disrupt the synchronization of operation or change the direction of the eccentric's rotation to cause jamming. Therefore, wear on the surfaces only results in a decrease in the engine's efficiency or its stoppage.

The main task addressed by the use of a coulisse-eccentric motor is:

- automatic distribution of the supply and discharge of the working fluid into the internal volumes of the coulisse solely through the mechanism that converts linear motion into rotational motion without additional mechanisms, cams, valves, pushers, etc.;
- the components of the coulisse-eccentric motor have a small number of parts and are simple to manufacture;
- it allows for reversing the rotation of the eccentric shaft while in operation without stopping;
- it has a definite direction of rotation for the eccentric shaft when supplying the working fluid into the same channel;
- the components of the coulisse-eccentric motor do not experience significant impact loads;
- The wear of the components does not cause the jamming of the coulisse-eccentric motor but leads to a decrease in efficiency.

Description of additional technical results.

Thanks to the fact that in a coulisse-eccentric motor, especially when using external volumes of the coulisse, the working volume is a maximum of two external volumes of the coulisse and two internal volumes of the coulisse, where the same volume is used twice, the total working volume of the coulisse-eccentric motor relative to the entire volume is large. In a coulisse-eccentric motor, the timing of the supply or discharge of the working medium depends on the relative position and sizes of the openings that connect one part of the channel in the eccentric to the other part of the channel in the side wall of the housing. Therefore, by changing their relative arrangement and sizes, it is possible to modify the timing and duration of the supply of the working medium to the internal volumes of the coulisse. By using several channels with their own openings in the side wall of the housing or its shaft, it is possible to utilize different types of working mediums in a single working cycle.

The coulisse-eccentric motor can have a coulisse with two or more internal chambers where their own eccentrics with shafts are located. The internal chambers of the coulisse are usually made with the same tilt relative to the guiding body, but they can have different sizes. The use of multiple internal chambers allows for the use of different types of working fluids that will be supplied to different eccentrics. There is also the possibility of reusing the working fluid when the spent working fluid from one eccentric is fed into the second eccentric. If the housing of the coulisse-eccentric motor—is heated and water is supplied to the internal volumes of the coulisse, the coulisse-eccentric motor simultaneously performs the functions of a steam boiler—a steam generator and engine.

When a piston—coulisse stone-is used in a coulisse-eccentric motor, it temporarily blocks the openings through which the working fluid is supplied or discharged to the internal volumes of the coulisse. The use of a piston—coulisse stone-allows for eliminating the phenomenon where the working fluid directly flows from the inlet to the outlet and also changing the timing and duration of the working fluid's supply to the internal volumes of the coulisse.

1—side walls of the housing, one of which is removed;
2—insert connecting the two side walls of the housing;
3—guide of the housing;
4—coulisse;
5—eccentric;
6—working surface of the eccentric;
7—shaft of the eccentric;
8—hole in the shaft of the eccentric;
9—channel in the body and shaft of the eccentric connecting holes 8 and 10;
10—hole on the working surface of the eccentric;
14 and 15—internal volumes of the coulisse;
16—working surface of the coulisse.

Figure 2:
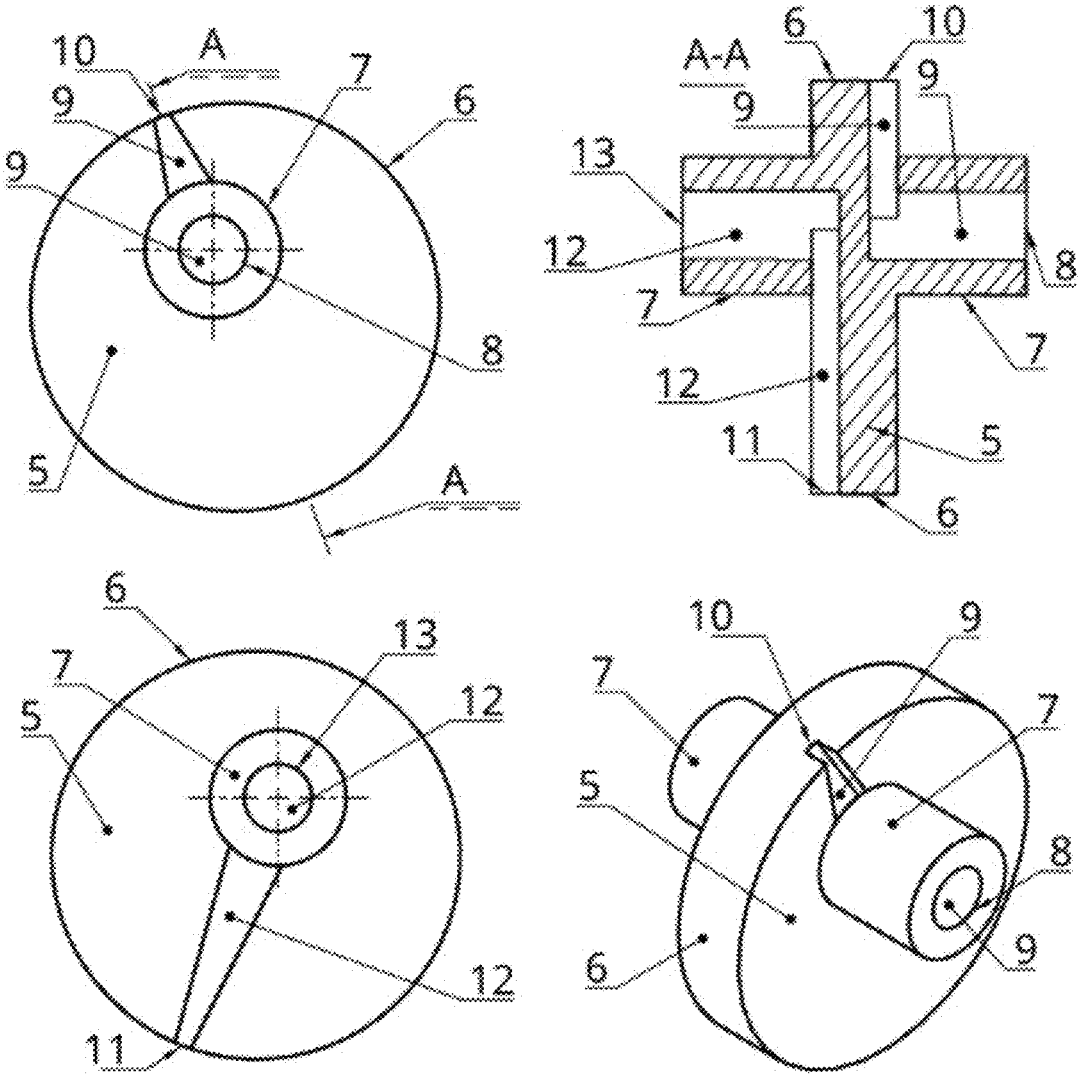

In FIG. 2 the eccentric is shown with the working body being fed through the hole in the eccentric shaft:

5—eccentric;
6—working surface of the eccentric;
7—shaft of the eccentric;
8—hole in the shaft of the eccentric;
9—channel in the body and shaft of the eccentric that connects hole 8 and 10;
10—hole on the working surface of the eccentric;
11—hole on the working surface of the eccentric;
12—channel in the body and shaft of the eccentric that connects hole 11 and 13;
13—hole in the shaft of the eccentric.

Figure 3:
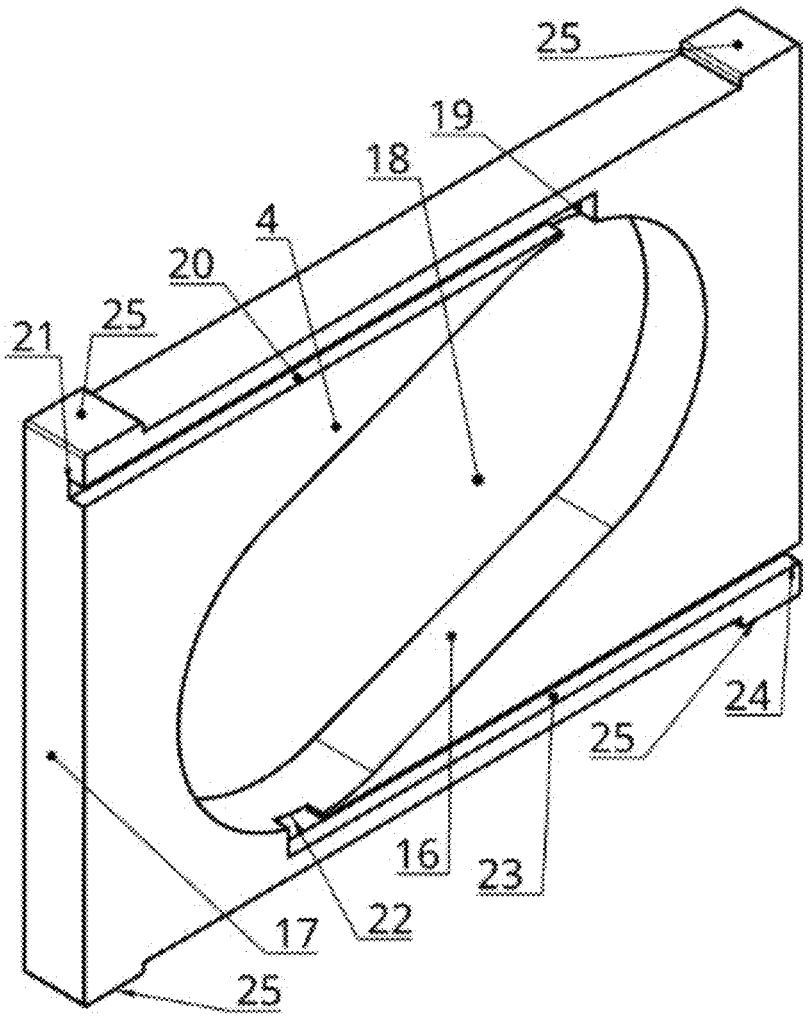

In FIG. 3 a coulisse is depicted according to paragraph 4 of the invention claim for delivering the working fluid to the external volumes of the coulisse:

4—coulisse;
17—surface of the coulisse that limits the external volume of the coulisse;
18—internal chamber of the coulisse;
19—opening located inside the internal chamber of the coulisse;
20—channel connecting opening 19 with opening 21;
21—opening located in the external volume of the coulisse;
22—opening located inside the internal chamber of the coulisse;
23—channel connecting opening 19 with opening 21;
24—opening located in the external volume of the coulisse;
25—surfaces of the coulisse that slide along the guideways of the housing.

Figure 4:
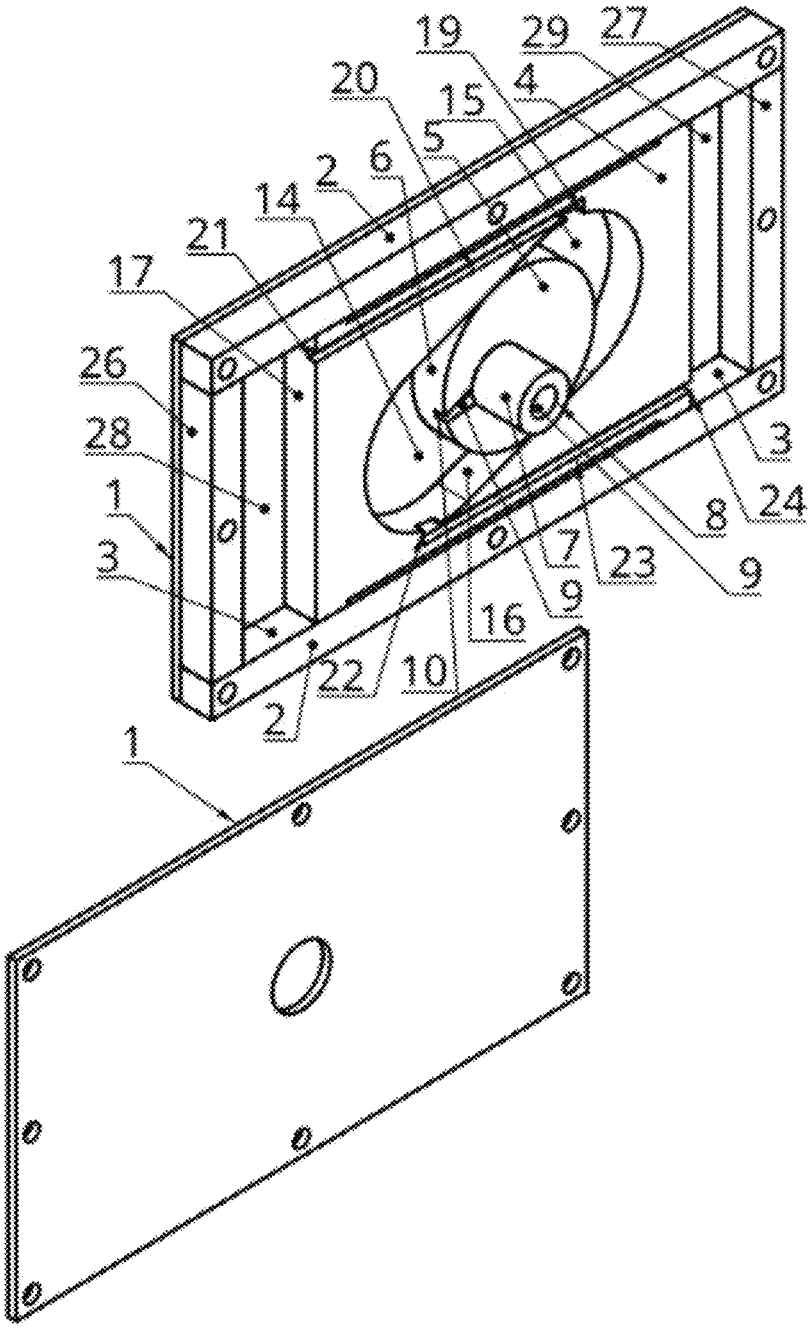

In FIG. 4 a coulisse-eccentric motor is depicted according to point 4 of the formula when external volumes of the coulisse are used:

1—side walls of the housing, one of which is removed;
2—an insert that connects the two side walls of the housing;
3—guide of the housing;
4—coulisse;

5—eccentric;
6—working surface of the eccentric;
7—shaft of the eccentric;
8—hole in the shaft of the eccentric;
9—channel in the body and shaft of the eccentric that connects hole 8 and 10;
10—hole on the working surface of the eccentric;
14 and 15—internal volumes of the coulisse;
16—working surface of the coulisse;
17—surface of the coulisse that limits the external volume of the slider; 19—hole located inside the internal volume of the coulisse 15;
20—channel that connects hole 19 with hole 21;
21—hole located in the external volume of the slider 28;
22—hole located inside the internal volume of the coulisse 14;
23—channel that connects hole 19 with hole 21;
24—hole located in the external volume of the coulisse 29;
26 and 27—additional insert of the housing;
28 and 29—external volumes of the coulisse.

Figure 5:
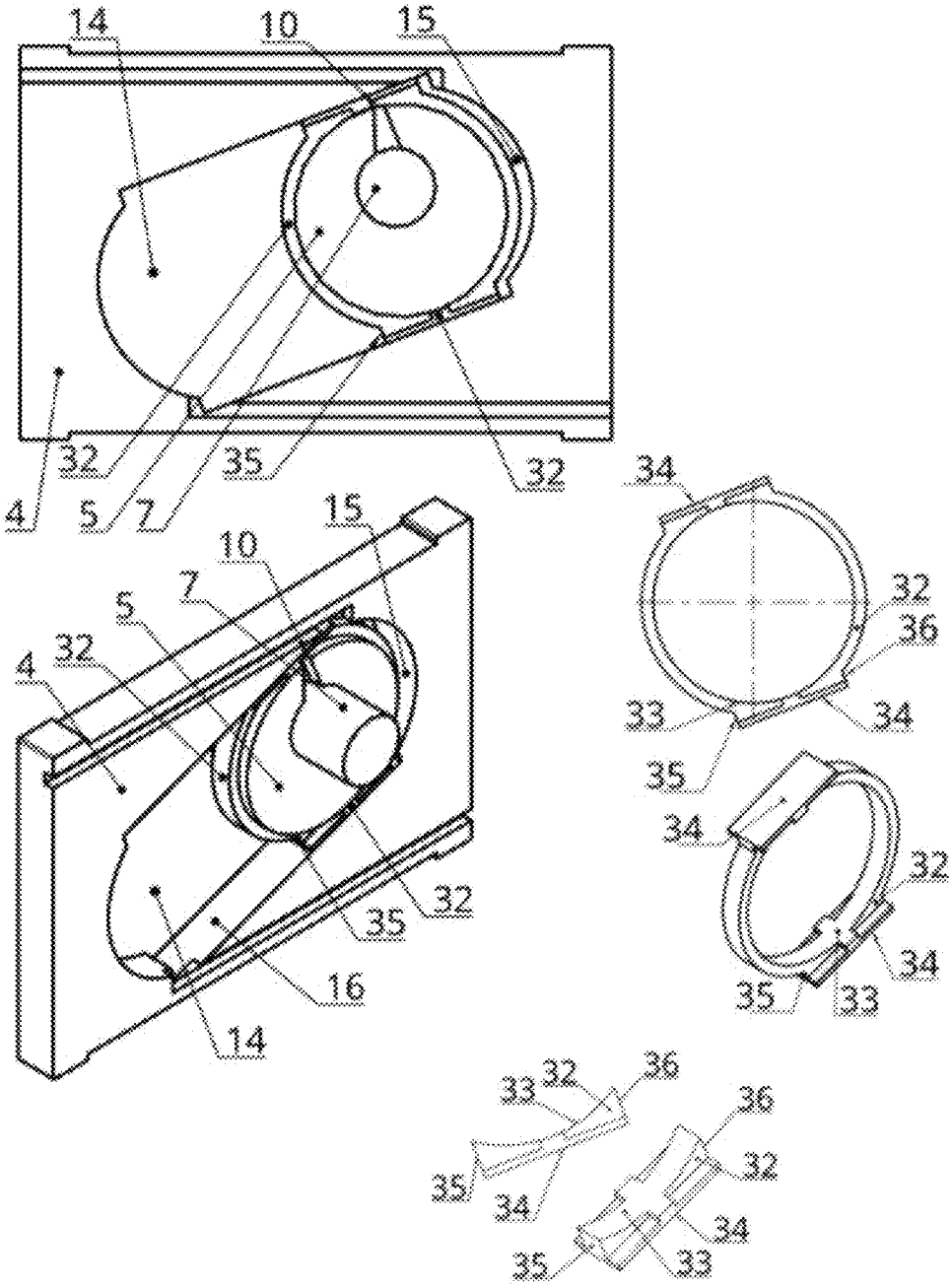

FIG. 5 shows the coulisse, the eccentric with the shaft, and the piston—coulisse stone, as well as the piston—coulisse stone for the variant where it consists of two parts to reduce friction on the working surface of the eccentric:
4—coulisse;
5-eccentric;
7—shaft of the eccentric;
9—channel in the body of the eccentric;
10—hole on the working surface of the eccentric;
14 and 15—internal volumes of the coulisse;
16—working surface of the coulisse;
32—piston—coulisse stone;
33—surface of the piston—coulisse stone that slides on the working surface of the eccentric;
34—surface of the piston—coulisse stone that slides on the opposite working surface of the coulisse 16;
35—surface of the piston—coulisse stone that limits the internal volume of the coulisse 14;
36—surface of the piston—coulisse stone that limits the internal volume of the coulisse 15.

Figure 6:
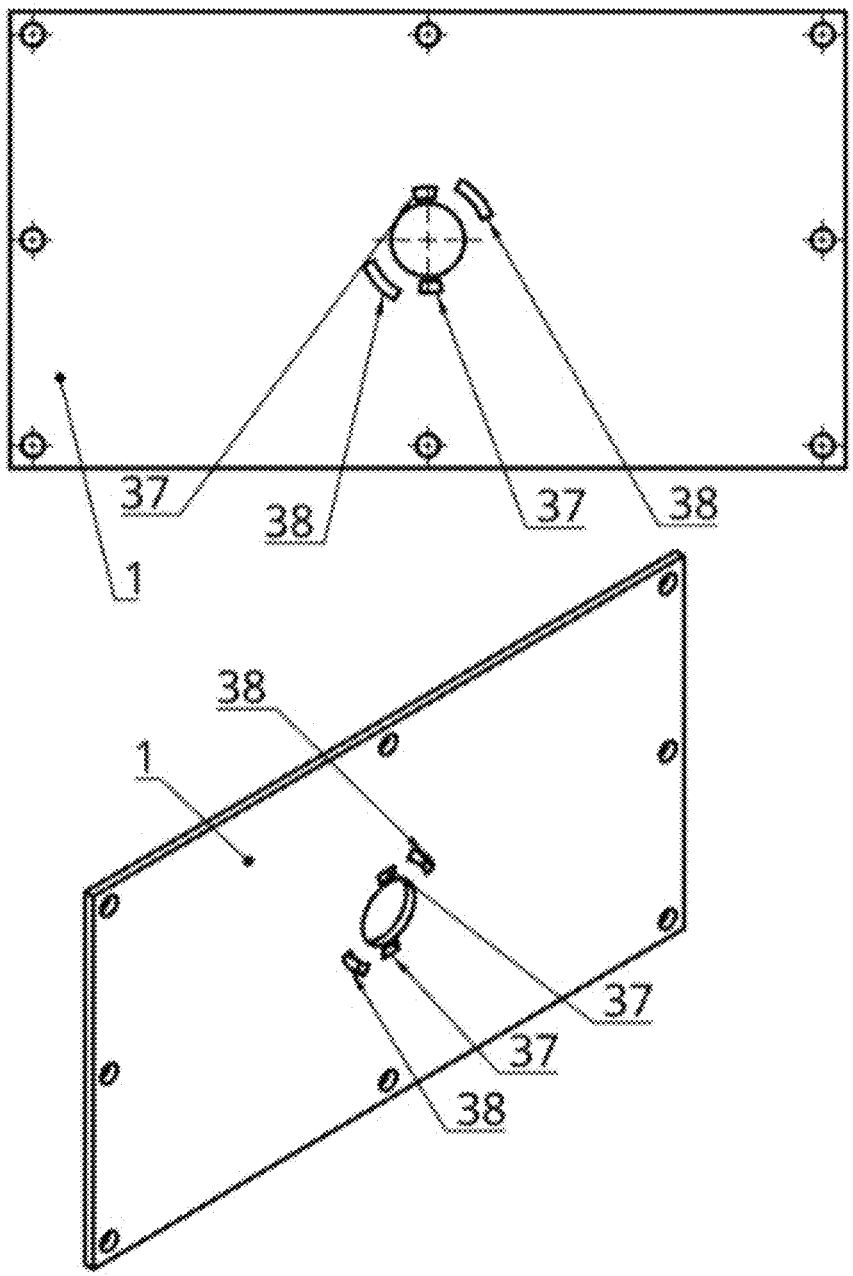

In FIG. 6 the side wall of the housing is shown for the variant of supplying the working fluid through the side wall of the housing:
1—side wall of the housing;
37 and 38—openings in the side wall of the housing.

Figure 7:
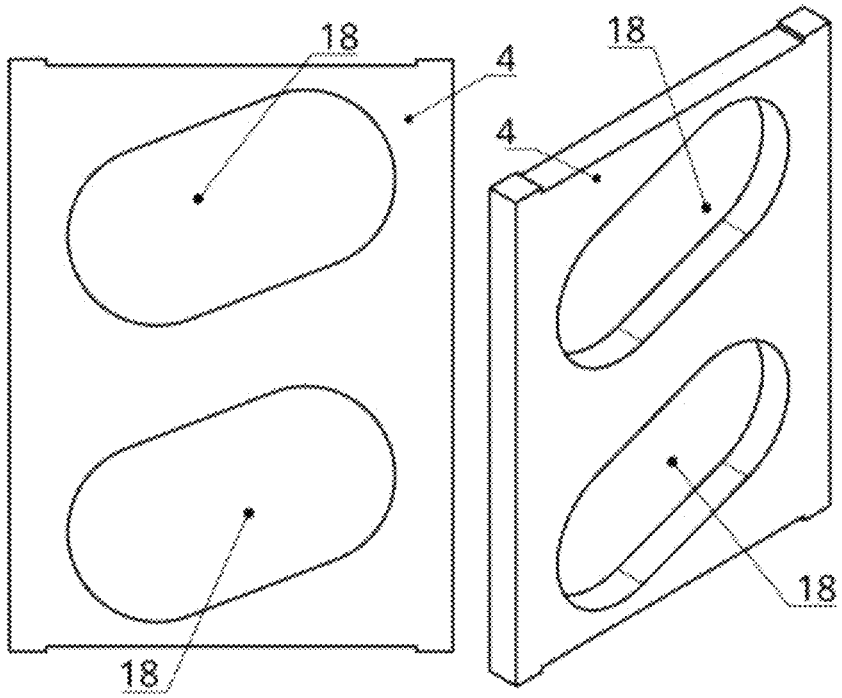

FIG. 7 shows an coulisse for the variant when more than one internal chamber of the coulisse is used:
4—coulisse;
18—internal chambers of the coulisse.

Figure 8:
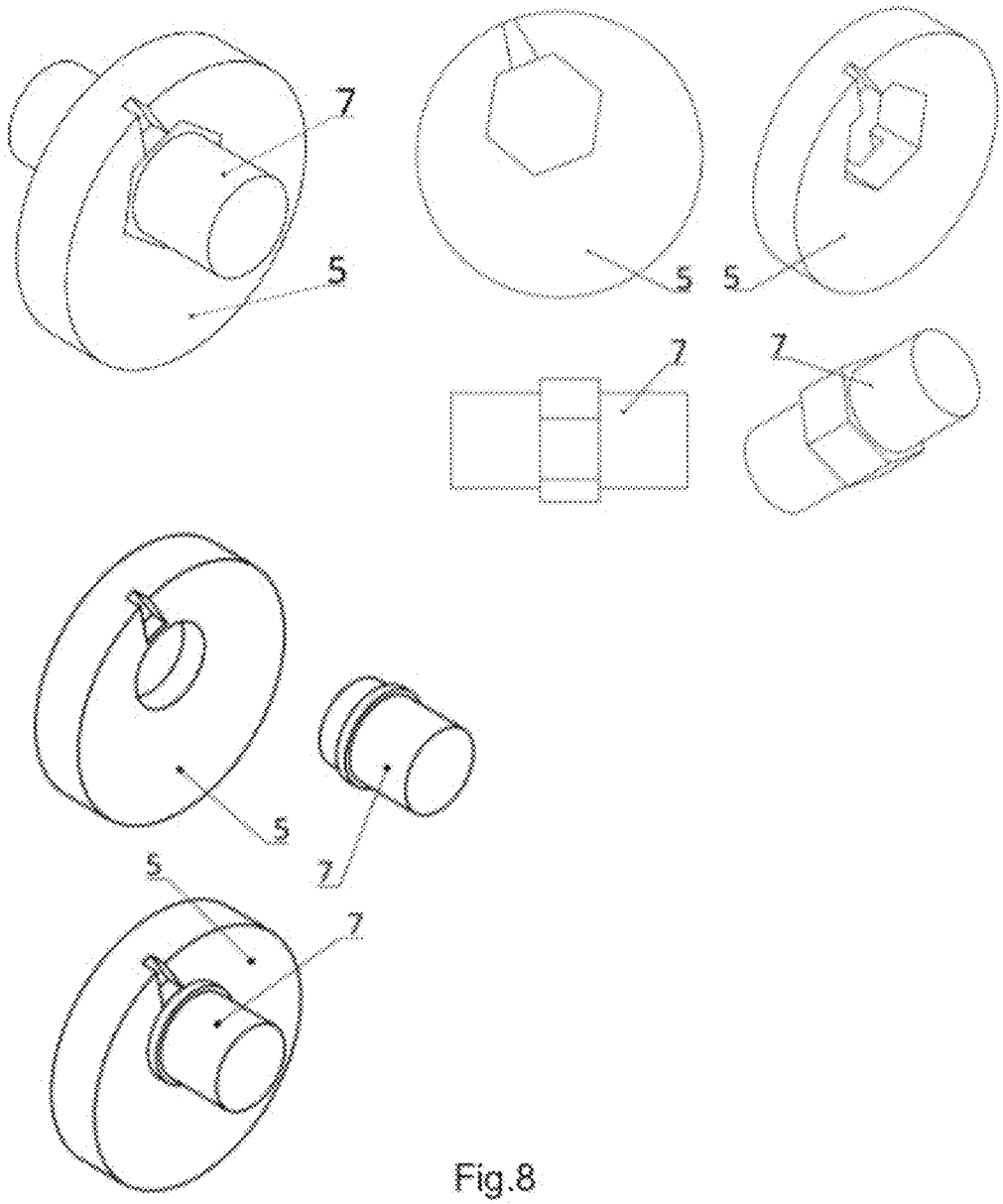

FIG. 8 depicts an eccentric with a shaft according to item 9 of the formula for the variant with a hole made hexagonal and corresponding to a separate shaft, and for the variant with a recess in the body of the eccentric with the corresponding shaft:
5-eccentric;
7—shaft of the eccentric.

Figure 9:
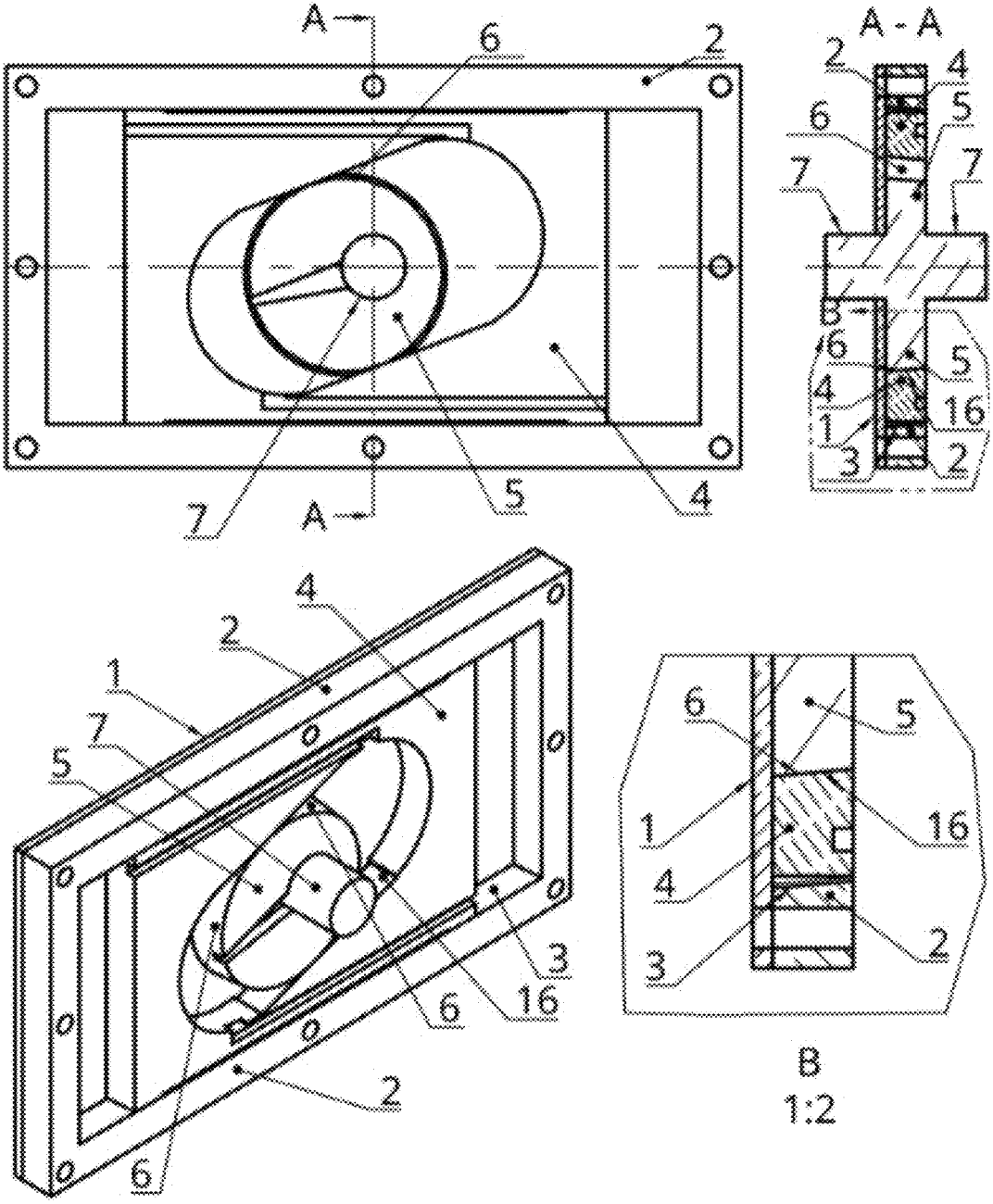

FIG. 9 shows a coulisse-eccentric motor according to clause 10 of the formula with one side wall of the housing removed and not shown:
1—side wall of the housing, one of them removed;
2—insert which is made as a single unit together with additional housing inserts, which connects two side walls of the housing;
3—a housing guide which has an inclination relative to the axis of rotation of the eccentric shaft and on which the surface of the coulisse slides accordingly;
4—coulisse;
5-eccentric;
6—working surface of the eccentric, which has an inclination relative to the axis of rotation of the eccentric shaft, and is made in the form of a truncated cone;
7-eccentric shaft;
16—working surface of the coulisse which has an inclination relative to the axis of rotation of the eccentric shaft.

BEST MODE FOR CARRYING OUT THE INVENTION

When the eccentric shaft is forcibly rotated, for example, by an electric motor, the coulisse-eccentric motor—can function as a pump or compressor without additional mechanisms and without any changes to the design. The coulisse-eccentric motor, can operate as a steam engine, an external combustion engine, an internal combustion engine, a pneumatic engine, a hydraulic engine, a vacuum engine, a pump, a compressor, or a steam generator. The coulisse-eccentric motor can convert thermal energy into rotational motion on the shaft by heating the casing and alternately supplying and releasing the working medium, such as water, to the internal volumes of the coulisse. Water transforms into steam, increasing pressure and causing the coulisse to move back and forth. This eliminates the most dangerous component of a steam engine-the high-pressure boiler. By using several internal chambers with their own eccentrics and shafts of different volumes, multiple expansions of steam can occur, allowing for more efficient use of steam energy. The small size of the coulisse-eccentric motor enables in the middle of a container with water, making the steam engine compact.

The coulisse-eccentric motor can perform all functions with a change in the type of working fluid without any structural changes or additions. For the supply and discharge of the working fluid to the internal volumes of the coulisse, the supply and discharge channels with their openings can pass through the body of the eccentric and then through the side walls of the housing. The number of openings with their channels is limited only by the design requirements. The coulisse-eccentric motor is very easy to scale by increasing the thickness or by connecting the shafts of several coulisse-eccentric motors. It is also possible to place multiple internal chambers within one coulisse, each with its own eccentrics and shafts. One internal chamber can receive fuel mixtures for subsequent ignition, while others can receive liquids or gases for extracting thermal energy, thereby increasing the engine's efficiency. Additionally, the small size of the coulisse-eccentric motor allows it to be placed inside a water container. This would enable the integration of an internal combustion engine, a steam boiler, a water container, and a steam engine, significantly reducing the weight and size of the steam machine. It also makes it very easy to reuse the working fluid after it has been used. One internal chamber of the coulisse receives the working fluid under high pressure and temperature, while it is discharged into the second internal chamber of the coulisse.

The volumes of the internal chambers can differ, which is important when using steam as the working fluid. There is also the possibility to separate the volumes where the working fluid—combustible mixtures—is supplied from the shaft with the eccentric from which the torque is extracted, minimizing the interaction between them. The torque and rotational speed of the shaft in a coulisse-eccentric motor can be adjusted by changing the pressure and the area of the inlet or outlet openings through which the working fluid is supplied and discharged. The torque on the eccentric shaft is determined by the diameter of the eccentric and the position of the eccentric shaft relative to the center of the working surface of the eccentric as well as the angle of inclination of the working surfaces of the coulisse relative to the guide housing, which allows for the adjustment of various operating modes.

The coulisse-eccentric motor has many ways to supply and discharge the working fluid to the internal volumes of the coulisse. It can be easily adapted to various requirements and can provide different working fluids in one cycle at different intervals using additional channels for the supply and discharge of the working fluid.

The coulisse-eccentric motor has a high efficiency, low vibrations, contains a minimum number of parts, is simple to manufacture, has a small size, high reliability, durability, and a high ratio of maximum working volume to the total engine volume. The coulisse-eccentric motor does not experience impact loads and is free from the main drawback of rodless piston engines-seizing due to minor wear of the friction surfaces. The coulisse-eccentric motor can be made miniature and entirely from ceramics, allowing it to be used as an artificial heart in life support systems, including within the human body. When used as a pump in artificial circulation systems, the coulisse-eccentric motor is devoid of the main disadvantages of existing solutions.

The coulisse-eccentric motor enables vacuum-venous blood drainage and generates both positive and negative pressure, eliminating the primary drawback of roller pumps—short lifespan of the tubing—and the limitation of centrifugal pumps—dependency on input and output load, unpredictability of blood volume, and lack of negative pressure at the inlet. In life support systems and transportation, the coulisse-eccentric motor can be powered by liquefied gas, such as nitrogen, oxygen, or compressed air, which serves as an energy storage medium and has higher reliability, durability, safety, and charging speed compared to electric batteries. When using pressurized oxygen in life support systems, by appropriately adding a membrane to the design, the coulisse-eccentric motor allows for membrane oxygenation of blood, including within the human body. The discharge of the working medium—gas—after oxygenation can be used for artificial ventilation of the lungs.

DETAILED DESCRIPTION

Figure 1:
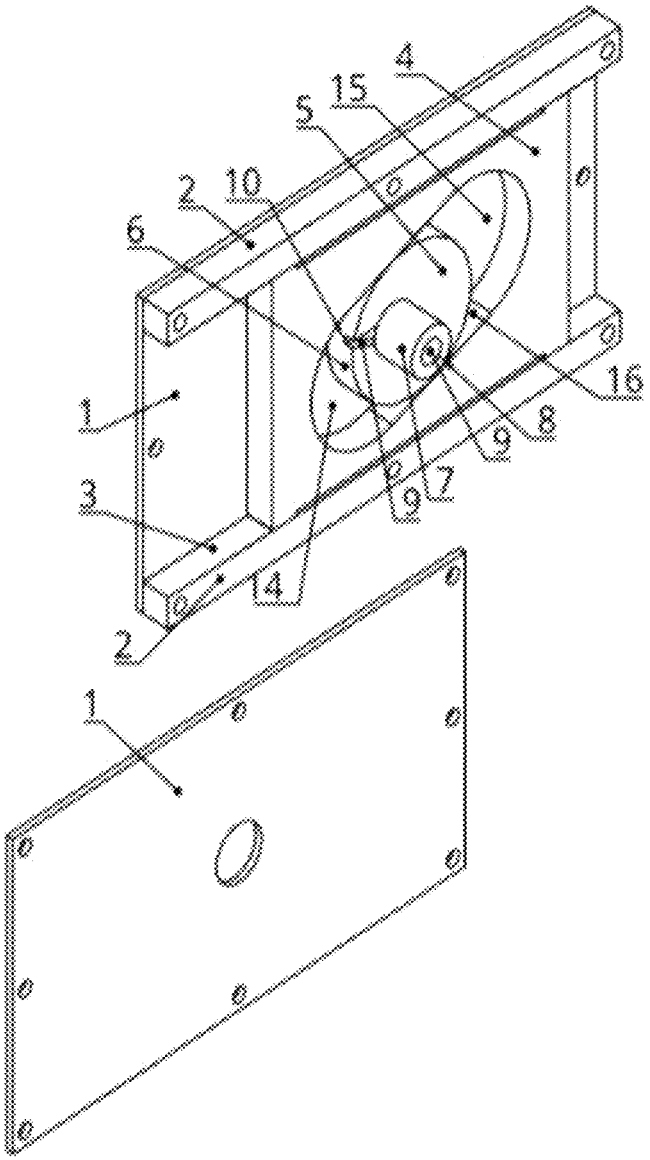
FIG. 1 shows a coulisse-eccentric motor with the working fluid supplied through a hole in the eccentric shaft.

The coulisse-eccentric motor shown in FIG. 1 consists of two side walls of the housing 1, one of which is removed, two inserts 2 that connect the side walls of the housing, housing guides 3, an coulisse 4, an eccentric 5 with the working surface of the eccentric6, and the shaft of the eccentric 7. The shaft of the eccentric has a hole 8 with its channel9 that runs through the shaft of the eccentric and the body of the eccentric, and which has a hole 10 on the working surface of the eccentric. On the opposite side of the eccentric, FIG. 2 shows a second hole 11 on the working surface of the eccentric with its channel 12 and a hole on the shaft of the eccentric 13. The coulisse-eccentric motor in FIG. 1 has internal volumes of the coulisse 14 and 15. The coulisse-eccentric motor has opposite working surfaces of the coulisse 16 that are positioned opposite each other relative to the eccentric, along which the working surface of the eccentric slides during its rotation. The distance between the opposite working surfaces of the coulisse is sufficient for the eccentric to rotate between them with the required clearance along its entire length.

The coulisse-eccentric motor shown in FIG. 1 operates as follows: the working fluid under pressure enters through the opening 8 on the eccentric shaft via channel9 and opening 10 on the working surface of the eccentric 6, reaching the internal volume of the coulisse 14. The increase in pressure in the internal volume of the coulisse 14 relative to the pressure in the internal volume of the coulisse 15 causes the coulisse 4 to move relative to the eccentric, increasing the internal volume of the coulisse 14 while simultaneously decreasing the internal volume of the coulisse 15. Due to the tilt of the opposite working surfaces of the coulisse 16 relative to the guide of the housing, the movement of the coulisse causes the eccentric 5 to rotate. The rotation of the eccentric results in a change in the position of the opening 10 on the working surface of the eccentric relative to the opposite working surfaces of the coulisse 16. The decrease in the internal volume of the coulisse 15 facilitates the discharge of the working fluid from the previous cycle to the outside through the opening 11 on the working surfaces of the eccentric via channel 12 through the opening 13 on the eccentric shaft, as shown in FIG. 2. After the holes 10 and 11 in the working surface of the eccentric become aligned with the opposite working surfaces of the coulisse 16, they will close. The eccentric will then continue its rotation due to inertia, and holes 10 and 11 will end up in different internal volumes of the coulisse. Through hole 10, the working fluid will already be supplied to the internal volume of the coulisse 15, while through hole 11, the working fluid will be discharged from the internal volume of the coulisse 14. The increase in pressure in the internal volume of the coulisse 15, which causes a rise in pressure, dampens the movement of the coulisse and stops it, then changes the direction of its motion to the opposite. Meanwhile, the direction of rotation of the eccentric remains unchanged. After this, the cycle of operation of the coulisse-eccentric motor will repeat, but for other internal volumes of the coulisse.

When used in an coulisse-eccentric motor, the external volumes of the coulisse in the internal chamber of the coulisse 18 FIG. 3, an opening 19 with its channel 20 and opening 21 have been added to the body of the coulisse, as well as an opening 22 with its channel 23 and opening 24. The first channel in the body of the coulisse FIG. 4 has an opening 19 with its channel 20 and opening 21 and connects the internal volume of the coulisse 15 with the external volume of the coulisse 28. The second channel in the body of the coulisse has an opening 22 with its channel 23 and opening 24 and connects the internal volume of the coulisse 14 with the external volume of the coulisse 29. Additionally, to the housing of the coulisse-eccentric motor with the side walls of the housing 1 FIG. 4, inserts 2 with housing guides 3, additional housing inserts 26 and 27 have been added. The additional housing inserts 26 and 27, together with the side walls of the housing 1, the two surfaces of the coulisse 17, and the housing guides 3, form and limit the external volumes of the coulisse 28 and 29, which change when the coulisse moves within the housing.

When used in an coulisse-eccentric motor, the external volumes of the coulisse operate as follows: The working fluid, under pressure, enters through hole 8 in FIG. 4 onto the shaft of the eccentric 7 via channel9 and hole 10 on the working surface of the eccentric 6, reaching the internal volume of the coulisse 14. The increase in pressure in the internal volume of the coulisse 14 relative to the pressure in the internal volume of the coulisse 15 causes the coulisse 4 to move relative to the eccentric and the eccentric to rotate. The movement of the coulisse increases the internal volume of the coulisse 14 while simultaneously decreasing the internal volume of the coulisse 15. The increase in pressure in the internal volume of the coulisse 14 is transmitted through hole 22, channel 23, and hole 24 to the external volume of the coulisse 29, which further moves the coulisse in the same direction. The external volume of the coulisse 29 increases, while the external volume of the coulisse 28 decreases simultaneously. The decrease in the external volume of the coulisse 28 discharges the working fluid from the previous working cycle into the internal volume of the coulisse 15, which also decreases. The reduction in the internal volume of the coulisse 15 causes the discharge of the working fluid from the previous cycle through hole 11 in FIG. 2, channel 12, and hole 13.

After the holes 10 and 11 in the working surface of the eccentric become aligned with the opposite working surfaces of the coulisse 16 FIG. 4, they will close. The eccentric will then continue its rotation due to inertia, and holes 10 and 11 will end up in other internal volumes of the coulisse. Through hole 10, the working fluid will already be supplied to the internal volume of the coulisse 15, and the cycle of the coulisse-eccentric motor will repeat, but for other internal and external volumes of the coulisse. To reduce the leakage of the working fluid between the two internal volumes of the coulisse 14 and 15, it has a piston—coulisse stone 32 FIG. 5. The piston—coulisse stone also determines the timing and duration of the working fluid's supply to the internal volumes of the coulisse.

The piston—coulisse stone 32 has the following surfaces:

- surface 33 that slides along the working surface of the eccentric;
- surface 34 that slides along one opposite working surface of the coulisse 16;
- surface 35 that limits the internal volume of the coulisse 14;
- surface 36 that limits the internal volume of the coulisse 15.

The piston—coulisse stone separates the working surface of the eccentric from the opposite working surfaces of the coulisse and increases the contact surface, thereby reducing the flow of the working medium between the two internal volumes of the coulisse. The dimensions of surface 33 of the piston—coulisse stone that slides along the working surface of the eccentric determine the time and duration for which the opening 10 on the working surface of the eccentric will be closed. FIG. 5 also shows a variant of the piston—coulisse stone that consists of two parts.

If it is necessary to separately supply several working fluids at different intervals to the internal volumes of the coulisse in the side walls of the housing 1, as shown in FIG. 6, holes 37 and 38 are made, the sizes and placement of which ensure the required interval and timing for the supply or discharge of the working fluid. For example, fuel can be supplied through hole 37, while an oxidizer can be supplied through holes 38. When using several internal chambers of the coulisse 18 with their own eccentric shafts in the coulisse 4, as shown in FIG. 7, the operation of the coulisse-eccentric motor occurs similarly to what has already been discussed. In this case, the rotation of the two eccentrics occurs synchronously, and the internal chambers of the coulisse can have different volumes.

To compensate for the wear of the sliding surfaces, as shown in FIG. 8, where one side wall1 is removed and not shown, the coulisse-eccentric motor has the same components: the insert 2 that connects the side walls of the housing and is made as a single piece with additional housing inserts, the guide of the housing 3, the coulisse 4, the eccentric 5 with the working surface of the eccentric 6, the shaft of the eccentric 7, and the opposite working surfaces of the coulisse 16. The guide of the housing 3 is inclined relative to the axis of rotation of the eccentric shaft, and the corresponding surfaces of the coulisse that slide on it have the same inclination. The opposite working surfaces of the coulisse 16 also have an inclination relative to the axis of rotation of the eccentric shaft and correspond to the inclination of the conical working surface of the eccentric 6. Due to these inclinations, when the eccentric shaft is displaced along its axis, it is possible to compensate for the wear of the housing guides, the working surfaces of the slider, and the working surfaces of the eccentric. The gap that forms when the eccentric shaft is moved along its axis, between the side walls and the side surface of the eccentric and the side surface of the coulisse, is eliminated by reducing the distance between the side walls of the housing or the spacers.

Some negative forces that perform negative work in well-known types of engines perform positive work in a coulisse-eccentric motor, for example:

- The gap between the working surface of the eccentric and the working surface of the coulisse reduces the pressure between them as the working fluid passes through, thereby lifting the eccentric, reducing the gap, and decreasing friction between the working surface of the eccentric and the opposite working surface of the coulisse on the other side;
- The eccentric is an asymmetrical, unbalanced component. The centrifugal force that causes vibrations in other types of engines acts on the eccentric in the coulisse-eccentric motor and additionally presses on the working surface of the coulisse, allowing it to pass the dead center when the hole on the working surface of the eccentric aligns with the working surface of the coulisse;
- The change in the direction of movement at the extreme position of the coulisse utilizes the kinetic energy of the coulisse for additional compression of the working fluid. The working fluid is fed into a volume that was previously reduced, the movement of the coulisse is dampened, and it changes direction of movement.

The invention claimed is:

1. A coulisse-eccentric motor comprising:

a housing;

a coulisse; and an eccentric having a shaft on at least one of two side surfaces of the eccentric;

wherein the housing comprises two side walls connected by inserts, the shaft of the eccentric being configured to rotate in at least one of the two side walls, the coulisse being configured to perform a reciprocating motion between the two side walls of the housing;

wherein each of the inserts connecting the side walls of the housing has a surface-housing guide which serves as a guide for the coulisse, the surface-housing guide defining a straight line of a movement vector of the coulisse in the housing;

wherein the coulisse has surfaces sliding along the housing guides;

wherein the coulisse contains an inner chamber where the eccentric is located, the eccentric dividing the inner chamber into two internal volumes which are changed by rotation of the eccentric and movement of the coulisse;

wherein the inner chamber of the coulisse has two opposite working surfaces, on which the eccentric rotates, the two opposite working surfaces of the coulisse being located opposite each other at a distance sufficient for the rotation of the eccentric there between with a required clearance;

wherein the two opposite working surfaces of the coulisse have initial and final points which are touched by a working surface of the eccentric when the eccentric rotates, wherein a straight line passing through the initial and final points on the two opposite working surfaces of the coulisse has an angle of inclination less than 90 degrees and more than 0 degrees relative to the housing guide; and wherein the coulisse-eccentric motor further comprises at least one channel having holes for supplying and discharging a working fluid into the two internal volumes of the coulisse.

2. The coulisse-eccentric motor according to claim 1, comprising at least one channel passing through a body of the eccentric and the shaft of the eccentric.

3. The coulisse-eccentric motor according to claim 1, comprising at least one channel passing through a body of the eccentric and through one side wall of the housing.

4. The coulisse-eccentric motor according to claim 1, comprising additional inserts between the two side walls of the housing, and wherein the additional inserts connect the housing guides on both sides relative to the coulisse and do not limit the movement of the coulisse, and wherein two outer volumes of the coulisse are formed by the additional inserts, the two housing guides, a wall of the coulisse and the two side walls of the housing, and a body of the coulisse comprises channels having holes which connect one of the two internal volumes of the coulisse to one of the two outer volumes of the coulisse, said one of the two outer volumes of the coulisse being located on an opposite side relative to the eccentric.

5. The coulisse-eccentric motor according to claim 4, wherein the coulisse additionally comprises one or more inner chambers, each provided with the eccentric having a shaft.

6. The coulisse-eccentric motor according to claim 5, comprising at least one piston—coulisse stone which is located in a middle of the respective one of the one or more inner chambers of the coulisse between the two side walls of the housing, wherein the at least one piston—coulisse stone has a first surface sliding along the working surface of the eccentric, a second surface sliding along the two opposite working surfaces of the coulisse, and two other surfaces located on opposite sides relative to the eccentric which limit the two internal volumes of the coulisse, wherein the two opposite working surfaces of the coulisse serve as guides for the piston—coulisse stone, and wherein a surface area of the piston—coulisse stone which slides along the working surface of the eccentric is larger than an area of the hole on the working surface of the eccentric through which the working fluid is supplied or discharged into the two internal volumes of the coulisse.

7. The coulisse-eccentric motor according to claim 6, wherein a part of the housing or the coulisse that is in contact with the two internal volumes of the coulisse or the outer volumes of the coulisse has a surface that transmits at least one type of gas.

8. The coulisse-eccentric motor according to claim 7, wherein the shaft of the eccentric is arranged on one of the two side surfaces.

9. The coulisse-eccentric motor according to claim 8, wherein the eccentric shaft is made in a form of a separate shaft that is inserted into the eccentric, and the eccentric has a hole or recess into which the separate shaft is inserted.

10. The coulisse-eccentric motor according to claim 8, wherein the housing guide, the surface of the coulisse that slides on the housing guide, the working surface of the coulisse, and the working surface of the eccentric have an inclination relative to an axis of rotation of the eccentric.

* * * * *